US009434528B2

(12) United States Patent
Ashbaugh

(10) Patent No.: US 9,434,528 B2
(45) Date of Patent: Sep. 6, 2016

(54) PILL DISPENSER

(71) Applicant: Rosemary Ashbaugh, Mattawan, MI (US)

(72) Inventor: Rosemary Ashbaugh, Mattawan, MI (US)

( * ) Notice: Subject to any disclaimer, the term of this patent is extended or adjusted under 35 U.S.C. 154(b) by 3 days.

(21) Appl. No.: 14/572,709

(22) Filed: Dec. 16, 2014

(65) Prior Publication Data

US 2015/0166247 A1 Jun. 18, 2015

Related U.S. Application Data

(60) Provisional application No. 61/916,325, filed on Dec. 16, 2013.

(51) Int. Cl.
*B65D 83/04* (2006.01)
*A61J 7/00* (2006.01)

(52) U.S. Cl.
CPC ..... *B65D 83/0409* (2013.01); *A61J 7/0076* (2013.01); *A61J 2205/40* (2013.01)

(58) Field of Classification Search
CPC .. A61J 7/0076; A61J 7/0084; A61J 2205/40; B65D 83/0409; B65D 83/0481
USPC ..... 221/236, 237, 196; 209/683
See application file for complete search history.

(56) References Cited

U.S. PATENT DOCUMENTS 2,134,180 A * 10/1938 Felber ..... B65D 83/0409 221/200
3,823,844 A * 7/1974 Linkemer ..... A61J 7/02 198/771
4,428,502 A * 1/1984 Veltri ..... B65D 83/0409 221/152
5,934,505 A * 8/1999 Shimada ..... B65G 47/1407 198/396
6,203,249 B1 * 3/2001 Ishida ..... H01L 21/67721 221/203
6,561,377 B1 * 5/2003 Pearson ..... A61J 7/02 221/13
7,726,514 B2 * 6/2010 Janet ..... A61J 7/02 221/13
7,735,684 B2 6/2010 Coe et al.
8,302,787 B2 11/2012 Tobey et al.
8,392,020 B2 * 3/2013 Terzini ..... A61J 7/02 700/232
2001/0013520 A1 * 8/2001 Eagle ..... B65D 83/0409 221/131
2002/0070227 A1 * 6/2002 Ferruccio ..... A61J 7/0084 221/15
2009/0127157 A1 5/2009 Costa et al.
2012/0285960 A1 11/2012 DeMarco et al.
2013/0116818 A1 5/2013 Hamilton

* cited by examiner

*Primary Examiner* — Patrick Mackey
(74) *Attorney, Agent, or Firm* — Daniel Boudwin; Global Intellectual Property Agency

(57) ABSTRACT

A pill dispenser for use with a pill container. The present invention describes a dispensing apparatus for a pill container comprising a housing, a rotatable closure to which a pill container may be mounted in an inverted orientation, a hopper for collecting pills emptied from the pill container into the housing, and a rotatable spool that is adapted to receive pills from the hopper. The spool comprises one or more slots that are sized to receive pills of various sizes and shapes. A metering sleeve rotatably disposed around the spool selectively covers all but one of the slots of the spool. Users can select the setting of the metering sleeve corresponding to the size and shape of the pill that they are seeking to dispense, ensuring that a single pill is received in the corresponding slot of the spool.

19 Claims, 7 Drawing Sheets

PILL DISPENSER

CROSS REFERENCE TO RELATED APPLICATION

This application claims the benefit of U.S. Provisional Application No. 61/916,325 filed on Dec. 16, 2013. The above identified patent application is herein incorporated by reference in its entirety to provide continuity of disclosure.

FIELD OF THE INVENTION

The present invention relates to pill dispensers. More specifically, the present invention relates to support stands for pill containers that allow for a single pill to be dispensed from the pill container at a time.

BACKGROUND OF THE INVENTION

When an individual is forced to take medication multiple times per day, having to constantly open a pill container, retrieve the necessary dosage, and then re-close the pill container can be very inconvenient. Furthermore, it can also be difficult for individuals with poor dexterity to retrieve the required dosage of medication because of the size of the pills and the designs of the pill containers. Therefore, there is a need in the prior art for a device that is adapted to quickly and conveniently dispense a measured number of pills from a pill container, without the need to remove the lid of the pill container each time the user wishes to retrieve pills therefrom.

SUMMARY OF THE INVENTION

The present invention comprises a dispensing apparatus for a pill container comprising a housing, a rotatable closure to which a pill container may be mounted in an inverted orientation, a hopper for collecting pills emptied from the pill container into the housing, and a rotatable spool that is adapted to receive pills from the hopper. The spool comprises one or more slots that are sized to receive pills of various sizes and shapes. A metering sleeve rotatably disposed around the spool selectively covers all but one of the slots of the spool. Users can select the setting of the metering sleeve corresponding to the size and shape of the pill that they are seeking to dispense, ensuring that a single pill is received in the corresponding slot of the spool. The present dispenser provides users with a means to quickly and conveniently dispense the contents of a pill container without the need to constantly open and close the lid of the pill container.

In view of the foregoing disadvantages inherent in the known types of pill container dispensers now present in the prior art, the present invention provides a pill container dispenser wherein the same can be utilized for providing convenience for the user when seeking to remove pills from a pill container.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
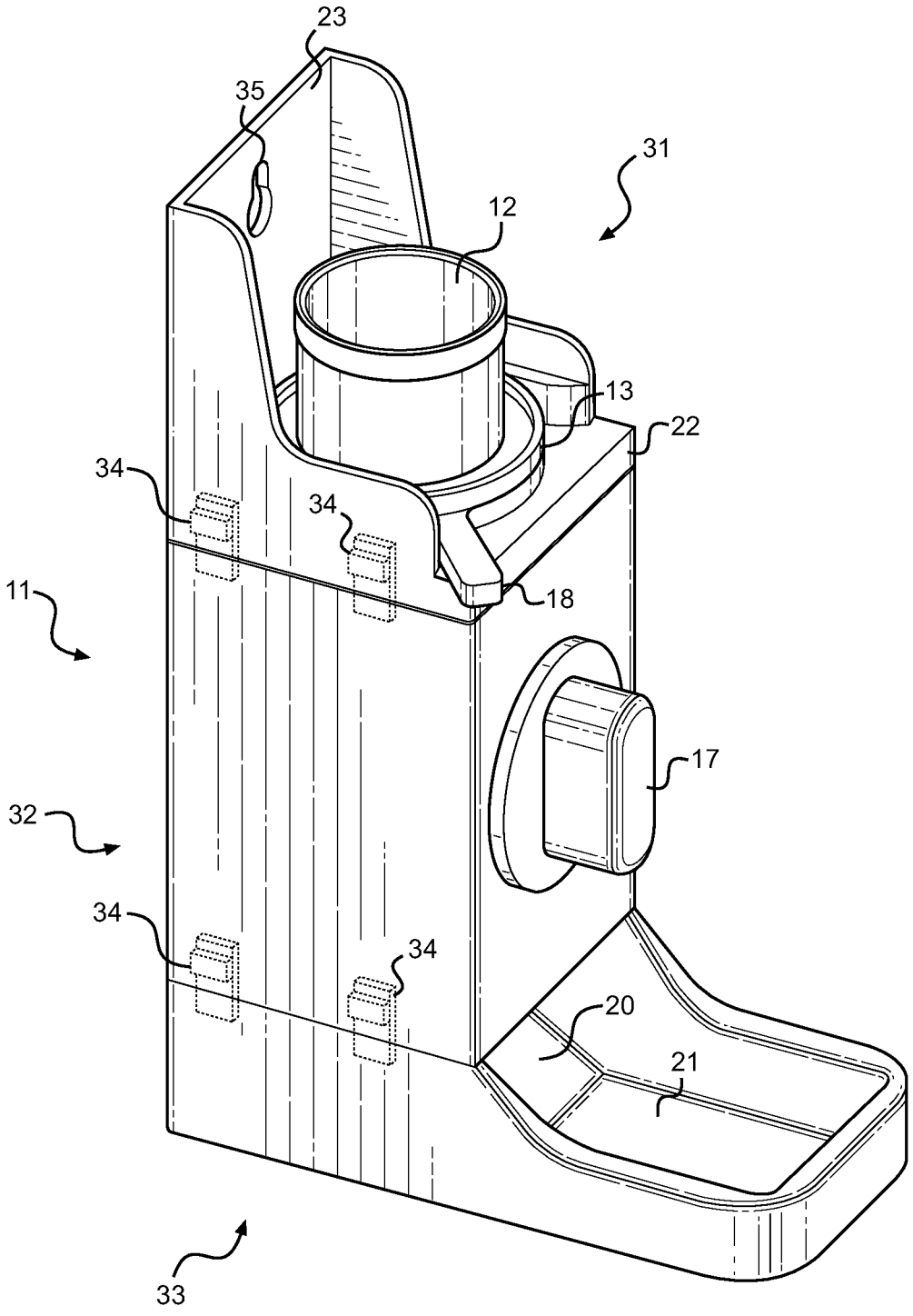
FIG. 1 shows a perspective view of the present invention.

Reference is made herein to the attached drawings. Like reference numerals are used throughout the drawings to depict like or similar elements of the pill container dispenser. For the purposes of presenting a brief and clear description of the present invention, the preferred embodiment will be discussed as used for removing pills from a pill container; however, the principles of the present invention are applicable to dispensing the contents from a wide range of types of containers. The figures are intended for representative purposes only and should not be considered to be limiting in any respect.

Figure 2:
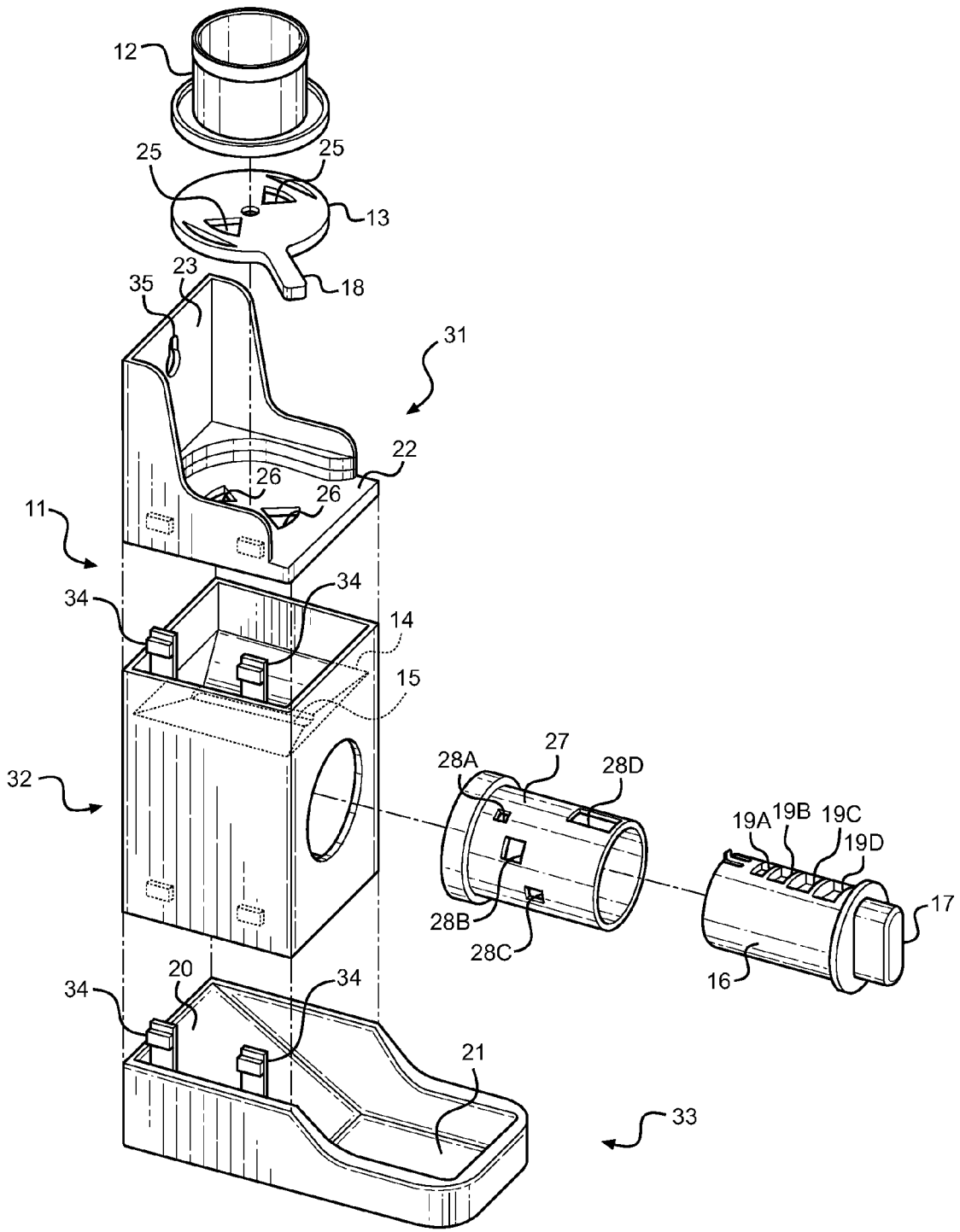
FIG. 2 shows an exploded view of the present invention.

Referring now to FIGS. 1 and 2, there are shown a perspective view of the present invention and an exploded view of the present invention. The present invention comprises a dispenser 11 to which a pill container can be removably affixed in an inverted orientation, i.e. with the open end of the pill container facing downwardly. With the pill container held in an inverted orientation, pills can be dispensed from the interior volume of the pill container without the need to remove the lid of the pill container each time that the user wishes to retrieve pills therefrom. The dispenser 11 comprises a first portion 31 comprising a container connector 12 that is adapted to hold a pill container in an inverted orientation, a second portion 32 that is adapted to funnel the pills and dispense them one at a time, and a third portion 33 that is adapted to receive the dispensed pills so that they can be retrieved by a user. The first, second, and third portions 31, 32, 33 are removably secured together by connectors 34. In the depicted embodiment of the present invention, the connectors 34 comprise quick-release connectors having a male portion that engages with a corresponding female portion, wherein depressing the male portion causes it to disengage and release from the female portion when engaged therewith. However, no claim is made as to the specific connectors 34 utilized to removably secure the first, second, and third portion 31, 32, 33 together. The first, second, and third portions 31, 32, 33 are separable for ease of cleaning and storage.

The first portion 31 comprises a first surface 22, a second surface 23 disposed in a perpendicular relationship thereto, a container connector 12, and a rotatable closure 13 disposed between the first surface 22 and the container connector 12. The container connector 12 is adapted to support a pill container in an inverted orientation so that the contents of the pill container can be dispensed therefrom. In the depicted embodiment, the container connector 12 comprises a tubular rigid member extending from the rotatable closure 13 into which a pill container can be placed to support the pill container in a vertical position. In another embodiment, the container connector 12 comprises a semi-rigid lip that is adapted to receive the lip of the pill container extending around the peripheral edge of the pill container open end 52. The pill container open end 52 can be snapped into the lip, securely holding the pill container in place. Another embodiment of the present invention is adapted for use with pill containers having screw tops. In this embodiment of the present invention, the container connector 12 comprises a tubular member extending from the rotatable closure 13 having internal, female threading that is adapted to engage the male threading disposed around the open end 52 of a pill container, thereby allowing the present invention and the pill container to be securely affixed together. The tubular member comprises a cylindrical shape to accommodate the cylindrical open tops of pill containers having screw tops.

The first surface 22 comprises one or more apertures 26 and the rotatable closure 13 comprises an equal number of apertures 25 having a corresponding size and shape. The rotatable closure 13 comprises a lever 18 that can be used to actuate the closure 13. The rotatable closure 13 is adapted to transition between an open position in which the first surface apertures 26 and the closure apertures 25 are out of alignment, preventing the contents of the pill container from passing therethrough, and an open position in which the first surface apertures 26 and the closure apertures 25 are in alignment, permitting the contents of the pill container to be communicated therethrough to the hopper 14 situated below the first surface 22. In the depicted embodiment, there are two of each type of apertures 25, 26 and they have a substantially triangular shape. From the closed position in which the apertures 25, 26 are out of alignment, the closure 13 can be rotated 90 degrees in order to bring the apertures 25, 26 into alignment and allow the contents of the pill container mounted to the closure 13 to pass therethrough.

A hopper 14 is situated below the first surface 22 and receives the contents that fall from the interior volume of the pill container when the rotatable closure 13 is rotated into the open position. The hopper 14 comprises a plurality of tapered sidewalls that terminate at an elongated aperture 15. The tapered sidewalls direct all of the contents emptied from the pill container through the rotatable closure 13, towards the aperture 15 so that the contents can then be dispensed via the spool 16 disposed therebelow. The spool 16 comprises one or more slots 19, each of which comprises a recessed area adapted to receive a single pill from the hopper 14. As the spool 16 is rotated via the dial 17 or another such control, the slots 19 come in alignment with the hopper aperture 15, allowing for a single pill to be transmitted from the hopper 14 to the corresponding slot 19. The slots 19 are arranged on the spool 16 in a linear fashion. The depicted embodiment of the present invention further comprises a metering sleeve 27 that is rotatably disposed around the spool 16 and that is coaxial therewith. The metering sleeve 27 is independently rotatable from the spool 16. In the depicted embodiment of the present invention, the metering sleeve 27 is rotatable via actuation of a ridge that extends from the opposite surface of the second portion as the dial 17 for the spool 16. However, no specific means of controlling the rotation of the metering sleeve 27 is claimed herein. The metering sleeve 27 acts as a barrier between the spool 16 and the hopper 14, selectively preventing the contents of the hopper 14 from being transmitted into the slots 19 of the spool 16. In the depicted embodiment, the metering sleeve 27 leaves a single one of the slots 19 on the spool 16 uncovered, thereby ensuring that only one pill of a size or shape corresponding to the uncovered slot 19 may be transmitted therethrough.

After a pill has been received by one of the slots 19 of the spool 16 from the hopper 14, the user can rotate the spool 16 via the dial 17 or another such control in order to dispense the pill. As the spool 16 rotates, the slots 19 are turned over and the pill falls therefrom onto the third portion 33 of the dispenser 11. In the depicted embodiment, the third portion 33 comprises an angled portion 20 disposed directly below the spool 16 and a planar portion 21 at the base of the angled portion 20 from which a user can retrieve the dispensed pill. In one embodiment of the present invention, the planar portion 21 comprises a reflective upper surface that makes it easy for users to visualize the dispensed pill.

An alternative embodiment of the present invention is adapted to be mounted to a support surface, such as a wall. One such exemplary embodiment further comprises keyhole slots 35 disposed on the second surface 32, allowing the dispenser 11 to be hung from fasteners secured to a support surface. The present invention may also be mounted to a support surface via an adhesive layer, eyelets though which fasteners may be secured to a support surface, and other such means.

Figure 3A:
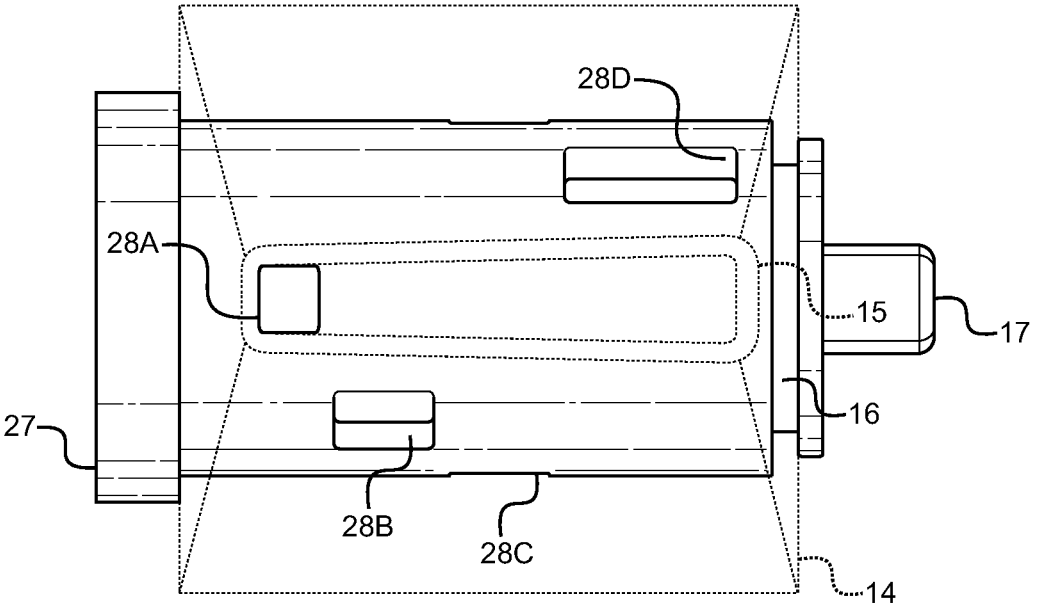
FIG. 3A shows a top-down cutaway view of the metering sleeve and spool portions of the present invention with the metering sleeve at a first setting.
Figure 3B:
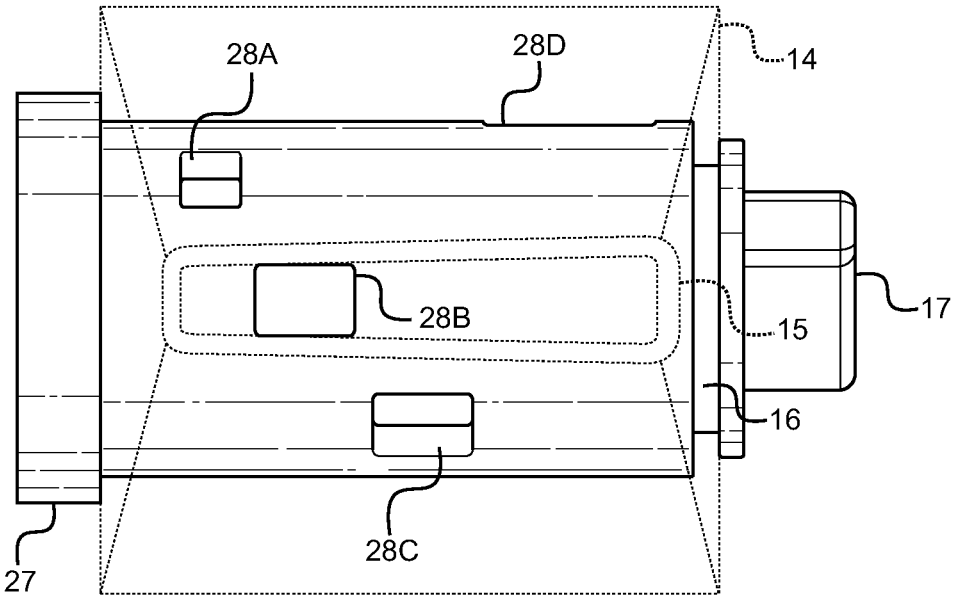
FIG. 3B shows a top-down cutaway view of the metering sleeve and spool portions of the present invention with the metering sleeve at a second setting.
Figure 3C:
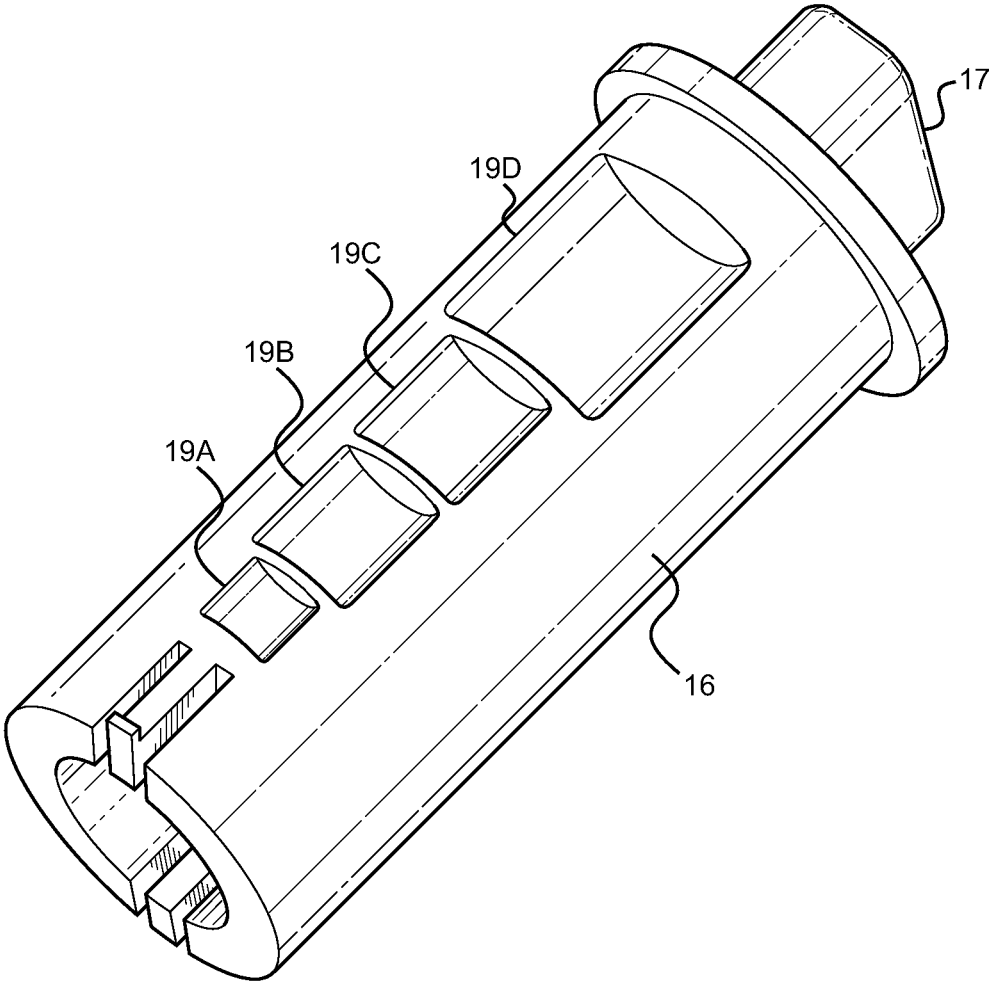
FIG. 3C shows a perspective view of the spool.

Referring now to FIGS. 3A and 3B, there are shown top-down cutaway views of the metering sleeve and spool portions of the present invention with the metering sleeve at various settings. The metering sleeve 27 provides users with a means to control which of the slots 19A, 19B, 19C, 19D disposed on the spool 16 are able to receive the contents of the hopper 14 through the hopper aperture 15. The metering sleeve 27 has a number of settings equal to the number of the openings 28A, 28B, 28C, 28D. Each setting for the metering sleeve 27 corresponds to one of the openings 28A, 28B, 28C, 28D being aligned with the hopper aperture 15. The openings comprise a first opening 28A that corresponds to the first slot 19A, a second opening that corresponds to the second slot 19B, a third opening 28C that corresponds to the third slot 19C, and a fourth opening 28D that corresponds to the fourth slot 19D, i.e. the openings 28A, 28B, 28C, 28D are at the same position along the length of the metering sleeve as the corresponding the slots 19A, 19B, 19C, 19D are along the length of the spool 16. The openings 28A, 28B, 28C, 28D are equal in number, size, and shape to the slots 19A, 19B, 19C, 19D disposed on the spool 16 to which they correspond. For example, the shape and the cross-sectional area of the first opening 28A are the same as the shape and the cross-sectional area of the corresponding first slot 19A, thereby allowing contents to be communicated from the hopper 14 to the first slot 19A without obstruction from the first opening 28A of the metering sleeve. As the slots 19A, 19B, 19C, 19D are adapted to only receive a single pill of the given size and shape and the openings 28A, 28B, 28C, 28D correspond to the slots 19A, 19B, 19C, 19D, the corresponding openings 28A, 28B, 28C, 28D are adapted to permit a single pill of the given size and shape therethrough.

The openings 28A, 28B, 28C, 28D are offset from each other relative to the longitudinal axis of the metering sleeve 27 such that only a single one of the openings 28A, 28B, 28C, 28D is able to be aligned with the hopper aperture 15 at one time. FIG. 3A shows the metering sleeve 27 positioned at the first setting in which the first opening 28A is aligned with the hopper aperture 15. Because the remaining openings 28B, 28C, 28D are offset from the first opening 28A, the contents of the hopper 14 can only fall through the first opening 28A to be received in the corresponding first slot 19A. FIG. 3B shows the metering sleeve 27 rotated from the first setting to the second setting in which the second opening 28B is aligned with the hopper aperture 15. Each of the openings 28A, 28B, 28C, 28D and their corresponding slots 19A, 19B, 19C, 19D is adapted for a pill of a different size or having a different shape. Therefore, the present invention can be used to dispense different types of types of pills as needed by the user by altering the setting of the metering sleeve 27.

The hopper aperture 15 is adapted to conform to the openings 28A, 28B, 28C, 28D so that they are not obstructed. In the depicted embodiment of the present invention, the width of the openings 28A, 28B, 28C, 28D increases from the first opening 28A to the fourth opening 28D. Therefore, the hopper aperture 15 comprises a tapered design so that it does not obstruct the passage of the contents of the hopper 14 therethrough.

The depicted embodiment of the present invention comprises four slots 19A, 19B, 19C, 19D disposed on the spool 16 (and a corresponding number of openings 28A, 28B, 28C, 28D disposed on the metering sleeve 27) for receiving four different types of pills; however, no claim is made as to a specific number of slots 19A, 19B, 19C, 19D utilized by the present invention. Furthermore, no claim is made as to the specific measurements or arrangement of the slots 19A, 19B, 19C, 19D, except insofar as that each of the slots 19A, 19B, 19C, 19D is adapted for use with a different type of pill, i.e. are sized and shaped to only accept one of the given type of pill therein.

Figure 4A:
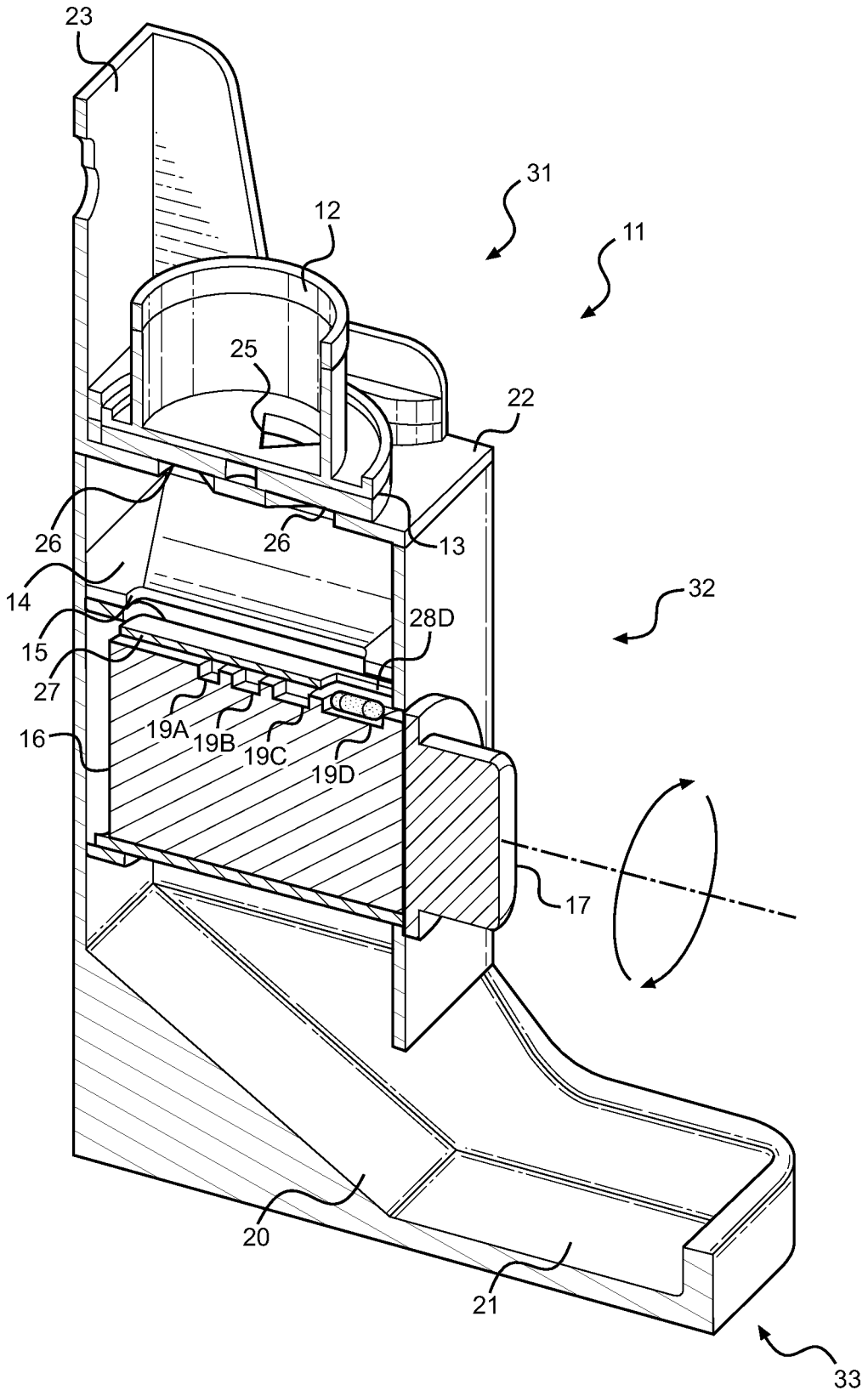
FIG. 4A shows a cross-sectional view of the present invention with the closure in a closed position.
Figure 4B:
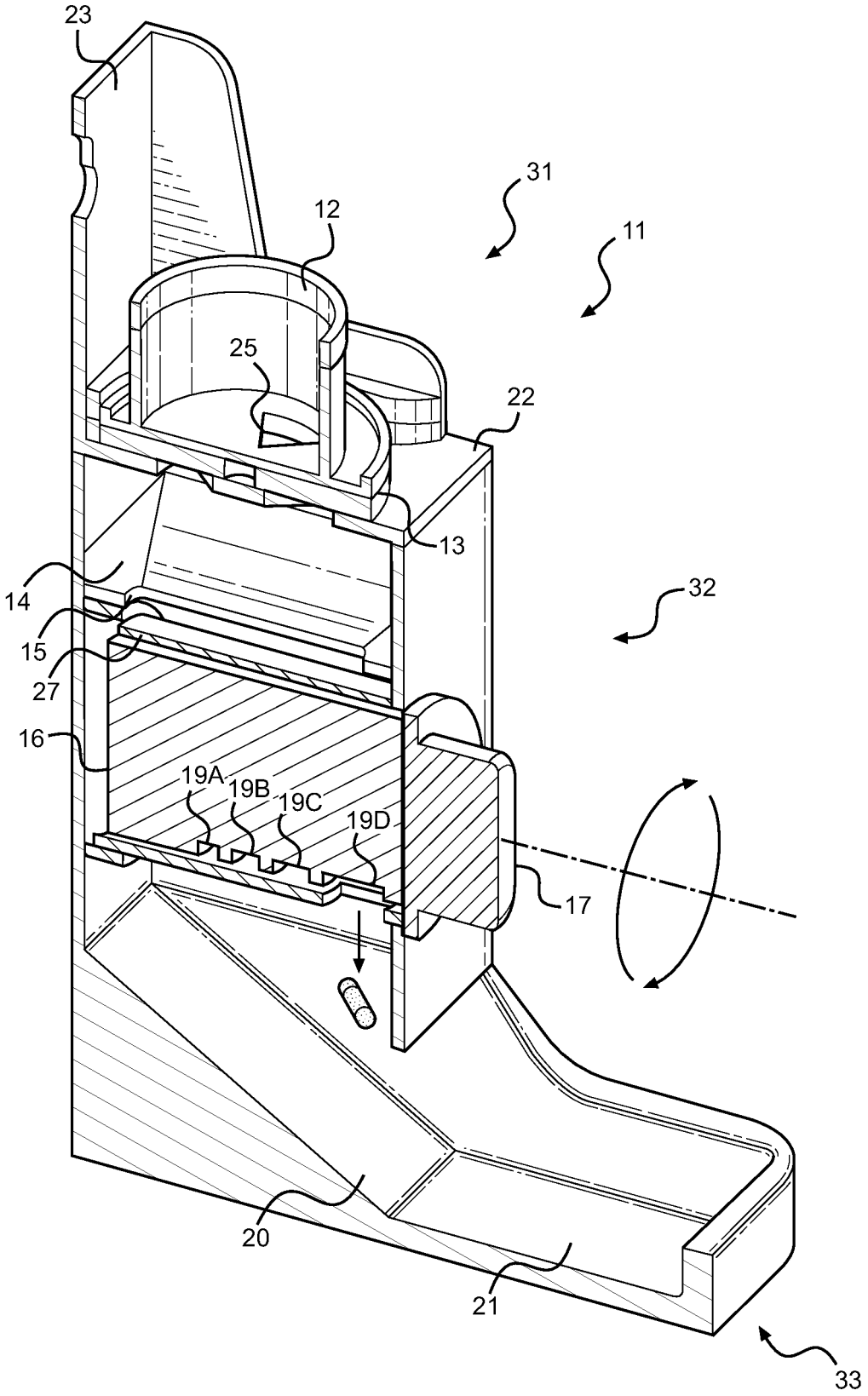
FIG. 4B shows a cross-sectional view of the present invention with the closure in an open position and dispensing a pill.

Referring now to FIGS. 4A and 4B, there are shown side cross-sectional views of the present invention along line Y-Y in a closed position and in an open position, dispensing a pill. Individuals make use of the present invention by first selecting the setting for the metering sleeve 27 that corresponds to the size of the pill that is to be dispensed. In the depicted exemplary embodiment of the present invention, the metering sleeve 27 comprises four settings corresponding to four different sizes or shapes of pills. Once the appropriate setting is selected, the user then attaches a pill container to the rotatable closure 13 via engagement between the container connector 12 and the pill container. The user then rotates the closure 13 to the open position, causing the contents of the pill container to empty therefrom into the hopper 14. The contents, e.g. pills, are then directed towards the hopper aperture 15 by the angled sidewalls of the hopper 14. The user then rotates the spool 16 until a slot 19 on the spool 16 comes into alignment with the corresponding opening 28 of the metering sleeve, as set by the user, and the hopper aperture 15. The slots 19 are only large enough to receive a single pill, therefore only a single pill is communicated from the hopper 14 into the slot 19 when the slot 19 comes into alignment with the hopper aperture 15. When the slot 19 corresponding to the opening 28 chosen by the user, i.e. the setting of the metering sleeve 27, is not in alignment with the hopper aperture 15, the surface of the spool 16 seals the hopper aperture 15, preventing the contents of the hopper 14 from falling therethrough. When a slot 19 is filled with a pill from the hopper 14, the user can then continue to rotate the spool 16 in order to dispense the pill therefrom.

Alternative embodiments of the present invention comprise multiple redundant corresponding sets of openings 28 and slots 19 disposed on the metering sleeve 27 and the spool 16, respectively. This allows individuals to choose the appropriate setting for the metering sleeve 27 by rotating the metering sleeve 27 in either clockwise or counterclockwise directions. For example, in one embodiment of the present invention the metering sleeve 27 comprises a first set of openings 28 and a second set of identical openings 28 that are separated by 180 degrees from the first set of openings 28. Therefore, if an individual is at the fourth setting of the first set of openings 28 and the individual wants to place the metering sleeve 27 at the first setting, the individual can either rotate the metering sleeve 27 in a counterclockwise direction to the first setting of the first set of openings 28 or rotate the metering sleeve 27 in a clockwise direction to the first setting of the second set of openings 28. Having multiple identical sets of openings 28 on the metering sleeve 27 provides greater flexibility to users in choosing the appropriate setting. As with the metering sleeve 27, alternative embodiments of the present invention comprises multiple identical sets of slots 19 disposed on the spool 16. This allows individuals to dispense pills from the hopper 14 without being forced to rotate the spool 16 the full 360 degrees that is necessary if there is only a single set of slots 19.

Figure 5:
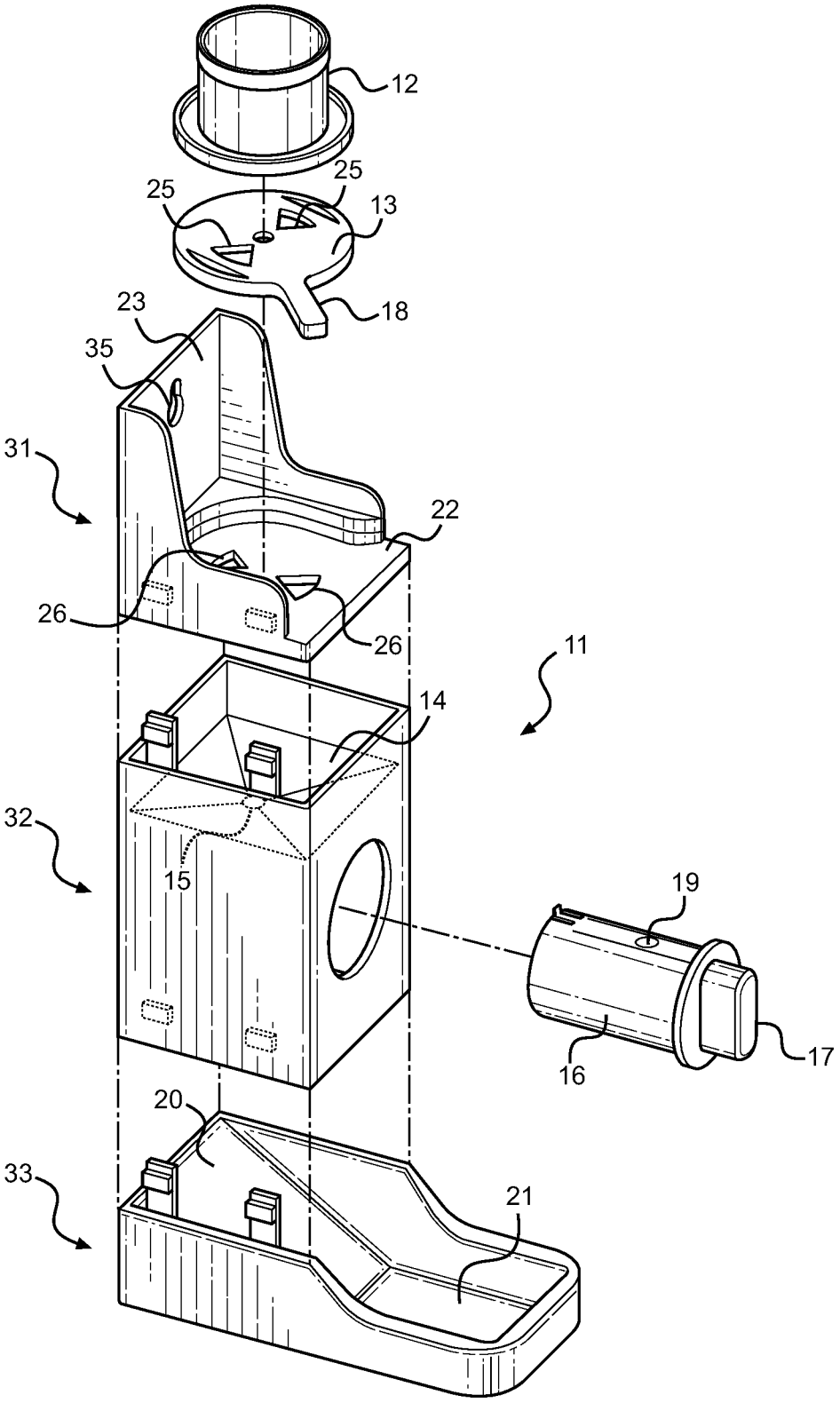
FIG. 5 shows an exploded view of an alternative embodiment of the present invention.

Referring now to FIG. 5, there is shown an exploded view of an alternative embodiment of the present invention. This alternative embodiment of the present invention lacks the metering sleeve and the spool 16 comprises a single slot 19 for receiving a pill from the hopper 14. This embodiment of the present invention is usable with only a single pill type of a predetermined size and shape. Rather than having a metering sleeve to funnel single pills from the hopper 14 to the corresponding slot 19 on the spool 16, the hopper aperture 15 itself is sized to allow only a single pill therethrough. The features of this embodiment of the present invention are otherwise identical to the embodiments of the present invention discussed above.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispenser, comprising:

a housing comprising an upper surface, a rotatable closure attached to the upper surface, a hopper disposed below the upper surface, a rotatable spool disposed below the hopper, and a base;

the upper surface comprising one or more apertures;

the rotatable closure comprising one or more apertures;

wherein the rotatable closure is adapted to transition between a closed position in which the one or more apertures of the upper surface are not aligned with the one or more apertures of the rotatable closure and an open position in which the one or more apertures of the upper surface are aligned with the one or more apertures of the rotatable closure;

wherein the rotatable closure is adapted to hold a container in an inverted orientation;

the hopper comprising an aperture;

the rotatable spool comprising one or more slots that are able to align the aperture of the hopper via rotation of the rotatable spool.

2. The dispenser of claim 1, further comprising:

a rotatable sleeve coaxial with the spool;

the sleeve comprising a plurality of offset openings;

wherein each of the plurality of offset apertures corresponds to one of the one or more slots of the rotatable spool.

3. The dispenser of claim 2, wherein each of the offset apertures has a different size.

4. The dispenser of claim 2, wherein each of the offset apertures has a different shape.

5. The dispenser of claim 2, wherein each of the offset apertures has a different size or shape.

6. The dispenser of claim 2, wherein each of the offset apertures is adapted for use with a different type of pill.

7. The dispenser of claim 2, wherein a cross-sectional area of the plurality of offset apertures of the sleeve is equal to a cross-sectional area of the one or more slots of the rotatable spool to which it corresponds.

8. The dispenser of claim 2, wherein the sleeve can be positioned such that one of the plurality of offset apertures is situated below the aperture of the hopper, allowing communication of contents of the container therethrough from the hopper to a corresponding slot of the rotatable spool.

9. The dispenser of claim 1, wherein the one or more apertures of the upper surface have a size and a shape corresponding to the one or more apertures of the rotatable closure.

10. The dispenser of claim 1, the one or more slots of the rotatable spool are adapted to receive only a single pill therein.

11. The dispenser of claim 1, the rotatable closure further comprising a lever, wherein actuation of the lever causes the rotatable closure to transition between the open position and the closed position.

12. The dispenser of claim 1, further comprising a reflective surface disposed on the base.

13. The dispenser of claim 1, wherein the aperture of the hopper is adapted to permit only a single pill therethrough.

14. The dispenser of claim 1, wherein:

the one or more slots of the rotatable spool comprise one slot;

wherein the aperture of the hopper is adapted to permit only a single pill therethrough.

15. The dispenser of claim 1, wherein the dispenser comprises a first portion, a second portion, and a third portion that are removably securable together via connectors.

16. The dispenser of claim 1, wherein the dispenser is mountable to a support surface.

17. The dispenser of claim 1, further comprising keyhole mounting slots disposed on the dispenser.

18. The dispenser of claim 1, further comprising a tubular member extending from the rotatable closure.

19. The dispenser of claim 1, further comprising a lever extending from the rotatable closure.

* * * * *